US008382093B2

(12) United States Patent
Dan

(10) Patent No.: US 8,382,093 B2
(45) Date of Patent: Feb. 26, 2013

(54) SHEET FEED DEVICE, IMAGE FORMING APPARATUS HAVING THE SAME, AND SHEET FEED METHOD

(75) Inventor: Kenichi Dan, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 20 days.

(21) Appl. No.: 13/076,655

(22) Filed: Mar. 31, 2011

(65) Prior Publication Data

US 2011/0291346 A1 Dec. 1, 2011

(30) Foreign Application Priority Data

Jun. 1, 2010 (JP) ..... 2010-125985

(51) Int. Cl.
*B65H 5/00* (2006.01)

(52) U.S. Cl. ..... 271/10.03; 271/110; 271/153; 271/154

(58) Field of Classification Search ..... 271/110, 271/111, 10.02, 10.03, 153, 154
See application file for complete search history.

(56) References Cited

U.S. PATENT DOCUMENTS

| | | | | |
|---|---|---|---|---|
| 4,838,534 | A * | 6/1989 | Ishikawa et al. | 271/10.03 |
| 5,667,215 | A * | 9/1997 | Yoshino | 271/258.01 |
| 5,676,363 | A | 10/1997 | Kishida et al. | |
| 5,732,307 | A * | 3/1998 | Yoshizuka et al. | 399/23 |
| 6,161,829 | A * | 12/2000 | Kusumi | 271/9.05 |
| 6,168,325 | B1 | 1/2001 | Nagata | |
| 6,361,038 | B1 * | 3/2002 | Tada et al. | 271/111 |
| 7,497,430 | B2 * | 3/2009 | Kusumi | 271/10.03 |
| 7,597,313 | B2 * | 10/2009 | Dan | 271/10.03 |
| 7,753,360 | B2 * | 7/2010 | Takeuchi et al. | 271/110 |
| 7,802,784 | B2 * | 9/2010 | Yamamoto | 271/117 |

FOREIGN PATENT DOCUMENTS

| | | |
|---|---|---|
| JP | H03-95043 | 4/1991 |
| JP | H05-286608 | 11/1993 |
| JP | H11-133685 | 5/1999 |
| JP | H11-227964 | 8/1999 |
| JP | H11-245460 | 9/1999 |
| JP | 2000-75734 | 3/2000 |
| JP | 2002-145469 | 5/2002 |
| JP | 2005-22792 | 1/2005 |
| JP | 2005-263452 | 9/2005 |

* cited by examiner

*Primary Examiner* — Kaitlin Joerger
(74) *Attorney, Agent, or Firm* — Scully, Scott, Murphy & Presser, P.C.

(57) ABSTRACT

A sheet feed device comprises: a retaining section retaining a sheet; a drive section raising the retaining section; a conveyance section conveying a sheet on the raised retaining section; a sheet detection section detecting an end of the conveyed sheet; and a control section. At the time that a sheet feed instruction is received, when a sheet is detected by the sheet detection section, the control section causes the conveyance section to feed the sheet further. When a sheet is not detected, the control section causes the drive section to raise the retaining section and then causes the conveyance section to start conveyance of a sheet.

12 Claims, 7 Drawing Sheets

SHEET FEED DEVICE, IMAGE FORMING APPARATUS HAVING THE SAME, AND SHEET FEED METHOD

CROSS-REFERENCE TO RELATED APPLICATIONS

This non-provisional application claims priority under 35 U.S.C. §119(a) on Patent Application No. 2010-125985 filed in Japan on Jun. 1, 2010, the entire contents of which are hereby incorporated by reference.

TECHNICAL FIELD

The present invention relates to a sheet feed device, an image forming apparatus comprising the sheet feed device and a sheet feed method and, in particular, to a technique of detecting a sheet feed state of the sheet feed device employed in the image forming apparatus.

BACKGROUND

As for detection of a sheet feed state of a sheet feed device employed in an image forming apparatus, for example, a technique that a sheet is previously fed until a sheet is detected by a pre-separation sensor is disclosed in Japanese Patent Application Laid-Open No. 2005-022792.

SUMMARY

In the technique described in Japanese Patent Application Laid-Open No. 2005-022792, when a pressing plate (retaining plate) for lifting sheets is normally in a raised state, variation is reduced satisfactorily in the sheet conveyance time. Nevertheless, as for the retaining plate onto which sheets are retained and which is raised so as to abut a sheet against a pickup roller, Japanese Patent Application Laid-Open No. 2005-022792 does not describe a technique of recognizing whether the retaining plate is in a completely raised state or in a not-yet completely raised state. Thus, for example, when a sheet is not detected by the pre-separation sensor, despite that the retaining plate is in a not-yet completely raised state, the pickup roller is uselessly driven until a sheet is detected. Therefore, there is a possibility that a sheet can not be fed satisfactorily. Further, when a dedicated sensor is provided for detecting a state of the retaining plate, a sheet is fed satisfactorily in accordance with the state of the retaining plate. Nevertheless, this causes a possibility of cost increase.

The present invention provides a technique for realizing satisfactory sheet feed at a reduced cost.

As means for achieving the above-mentioned object, a sheet feed device according to a first aspect is a sheet feed device comprising: a retaining section retaining a sheet; a drive section raising the retaining section; a first conveyance section conveying a sheet on the raised retaining section in a conveyance direction; a sheet detection section detecting one end of the conveyed sheet; a reception section receiving a sheet feed instruction; and a control section, at the time that the reception section receives a sheet feed instruction, when a sheet is detected by the sheet detection section, causing the first conveyance section to convey the sheet further and, when a sheet is not detected by the sheet detection section, causing the drive section to raise the retaining section and then causing the first conveyance section to start conveyance of a sheet.

According to this configuration, the presence or absence of a sheet and the rise state of the retaining section are detected by the sheet detection section. Thus, in comparison with a configuration that the detections are performed by separate detection sections respectively, the number of detection sections is reduced. Further, the waiting time for feed start is minimized in accordance with the rise state of the retaining section at the time of reception of a sheet feed instruction. That is, satisfactory sheet feed is realized at a reduced cost.

Here, "the time of reception of a sheet feed instruction" indicates the time that a sheet feed instruction is received in association with the start of printing operation for each sheet, during the execution of printing operation based on a printing instruction.

A sheet feed method according to a second aspect is a sheet feed method that employs a sheet feed device provided with a retaining section retaining a sheet, a drive section raising the retaining section, a conveyance section conveying a sheet on the raised retaining section in a conveyance direction and being capable of causing a sheet to stop at a predetermined position on a conveyance path, and a sheet detection section detecting one end of the conveyed sheet, the method for feeding a sheet when a sheet feed instruction to the sheet feed device is received, comprising: a raising step of the drive section raising the retaining section at a predetermined timing before a reception of the sheet feed instruction; a first conveying step of the conveyance section conveying a sheet after the raising step at least to a position where a front end of the sheet is detected by the sheet detection section; a step of the conveyance section stopping the sheet after the first conveying step according to detection of the sheet by the sheet detection section; a second conveying step of, at the time that the sheet feed instruction is received, the conveyance section conveying the sheet further when the sheet is detected by the sheet detection section; and a step of, at the time that the sheet feed instruction is received, causing the drive section to raise the retaining section and then causing the conveyance section to start conveyance of a sheet when a sheet is not detected by the sheet detection section.

According to this configuration, the sheet detection section serving as a minimal detection section satisfactorily detects the presence or absence of a sheet and the rise state of the retaining section. Further, since a sheet is fed prior to a sheet feed instruction, a sheet is fed rapidly when the sheet feed instruction is received.

According to the present invention, satisfactory sheet feed is realized at a reduced cost.

The above and further objects and features will more fully be apparent from the following detailed description with accompanying drawings.

DETAILED DESCRIPTION

Next, an embodiment of the present invention is described below with reference to FIGS. 1 to 6.

1. Overall Configuration of Printer

Figure 1:
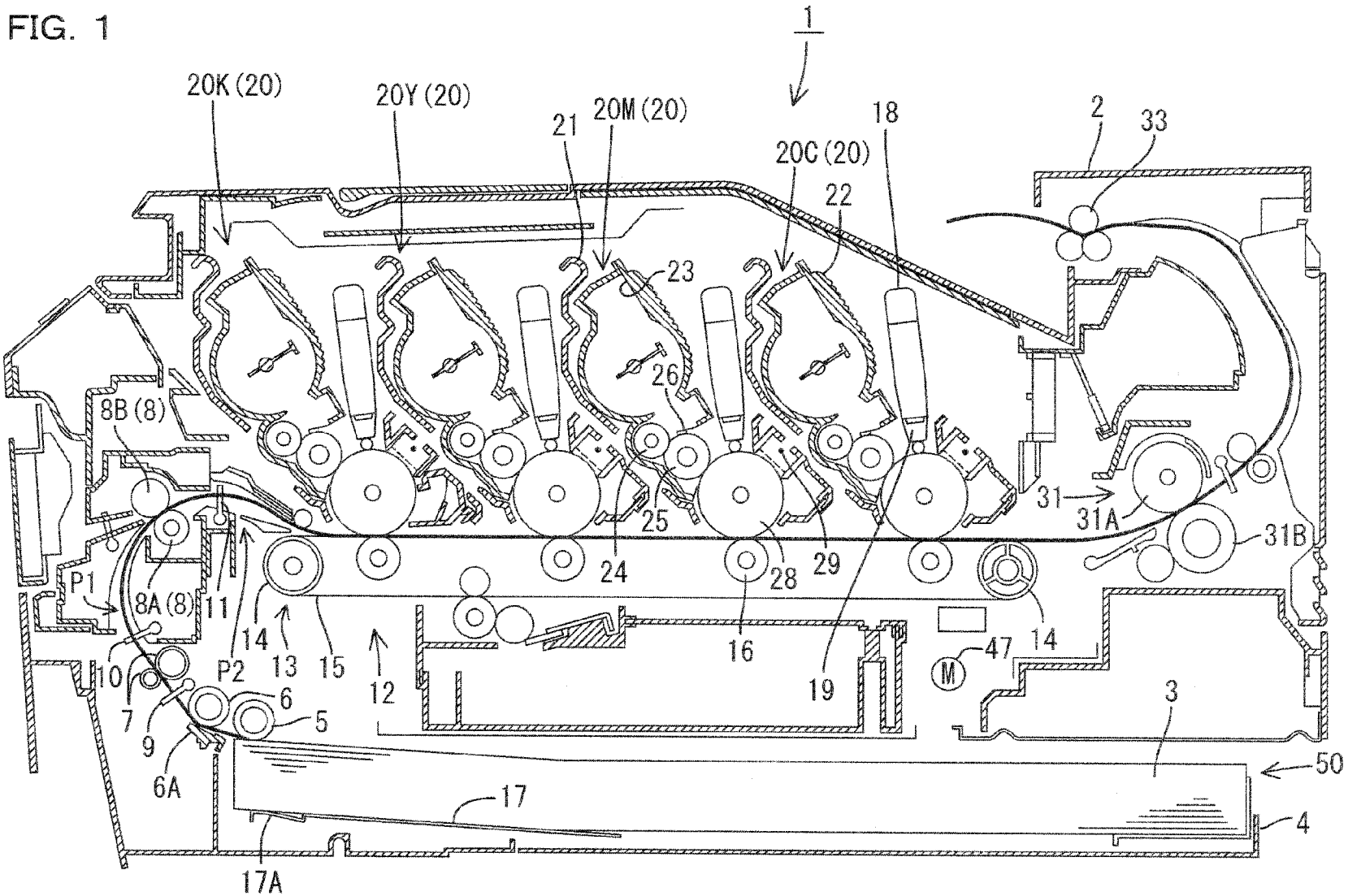
FIG. 1 is a sectional side view illustrating a schematic configuration of a printer according to an embodiment of the present invention.
Figure 2:
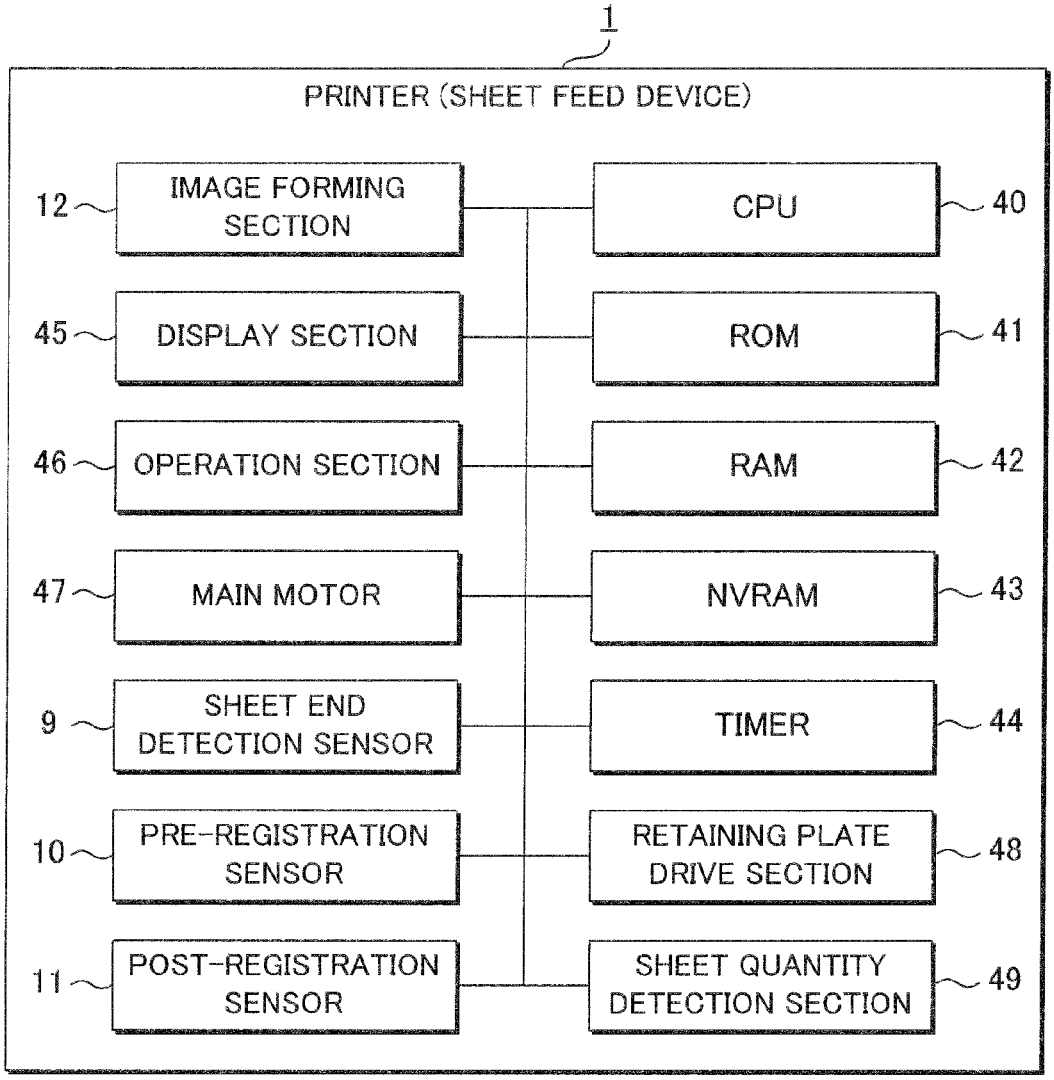
FIG. 2 is a block diagram schematically illustrating an electrical configuration of a printer.

FIG. 1 is a sectional side view illustrating a schematic configuration of a printer 1 serving as an example of an image forming apparatus of the present invention. FIG. 2 is a block diagram schematically illustrating the electrical configuration of the printer 1.

As illustrated in FIG. 1, the printer 1 is a color LED printer of direct tandem type that forms a color image by using toner of four colors (black K, yellow Y, magenta M, and cyan C). In the following description, the left-hand side in FIG. 1 is referred to as the front side, and the right-hand side is referred to as the rear side. Further, in FIG. 1, as for member components similar for the individual colors, their duplicated reference numerals are omitted in some cases. Here, the employed image forming apparatus is not limited to a color LED printer of direct tandem type and may be, for example, a color laser printer, a monochrome laser printer, or a multi-function peripheral having a copy function and the like.

The printer 1 has a body casing 2 and a sheet feed device 50 feeding a sheet 3 into the bottom part of the body casing 2. As illustrated in FIGS. 1 and 2, the sheet feed device 50 includes a sheet feed tray (an example of a "retaining unit") 4, a retaining plate (an example of a "retaining section") 17, a retaining plate drive section (an example of a "drive section") 48, a feed roller (an example of a "first conveyance section") 5, a separation roller (an example of a "first conveyance section") 6, a separation pad (an example of a "first conveyance section", a "separation member") 6A, a sheet end detection sensor (an example of a "sheet detection section") 9, and a CPU (an example of a "control section") 40.

The sheet feed tray 4 accommodates a plurality of sheets 3. The sheet feed tray 4 is movable between a housed position (first position) capable of feed of a sheets 3 and a drawn-out position (second position) incapable of feed of a sheet 3. When the sheet feed tray 4 is moved to a drawn-out position, the sheet feed tray 4 is drawn out to the left-hand side (the front side of the printer 1) in FIG. 1. The retaining plate 17 is provided inside the sheet feed tray 4, and retains the sheets 3 thereon and presses the sheets 3 against the feed roller 5 in a raised state.

The retaining plate drive section 48 raises the retaining plate 17 according to rotation of the main motor 47. Specifically, the retaining plate drive section 48 raises one end (one end on the left-hand side in FIG. 1) 17A of the retaining plate 17. Thus, as illustrated in FIG. 1, the retaining plate 17 is raised with a predetermined inclination. Here, the retaining plate 17 is raised, for example, according to power ON of the printer 1 or alternatively according to the operation that the sheet feed tray 4 is moved from the drawn-out position to the housed position. Further, during the operation that the sheet feed tray 4 is moved to the drawn-out position, linkage with a transmission mechanism (not illustrated) for transmitting a driving force from the retaining plate drive section 48 to the retaining plate 17 is released so that the raised retaining plate 17 is lowered.

The feed roller 5 is provided above the front end of the sheet feed tray 4. Then, in accordance with rotation of the feed roller 5, the uppermost sheet 3 retained inside the sheet feed tray 4 is sent out to the conveyance path P1 provided in a front part of the inside of the body casing 2. Here, the left-hand side in FIG. 1 is referred to as the front side of the sheet feed tray 4, and the right-hand side is referred to as the rear side. Here, the feed roller 5 can hold the sheet 3 in a state of being stopped at a predetermined position on the conveyance path P1. That is, a drive mechanism (not illustrated) for driving the feed roller 5 can stop the rotation of the feed roller 5 at a predetermined timing measured from the feed start time for the sheet 3. Here, the sheet 3 on the retaining plate 17 in a completely raised state can be fed, stopped, or held by the feed roller 5. On the other hand, during raising operation or alternatively in a lowered state, the sheet 3 on the retaining plate 17 can not be fed, stopped, or held by the feed roller 5.

The separation pad 6A opposes the separation roller 6 with the sheet 3 in between, and separates the uppermost sheet from the other sheets. For example, when the sheet feed tray 4 is in the housed position, the separation pad 6A contacts with the separation roller 6 by means of a mechanism (not illustrated) including a coil spring or the like. Further, during the time that the sheet feed tray 4 is moved to the drawn-out position, the separation pad 6A goes lower so that the contact with the separation roller 6 is released.

The sheet end detection sensor 9 detects the presence or absence of a sheet 3 fed by the feed roller 5 and the separation roller 6. Specifically, the sheet end detection sensor 9 is turned ON according to passage of the front end 3A of the sheet 3, and then is turned OFF according to passage of the rear end 3B of the sheet 3. That is, the sheet end detection sensor 9 detects whether the feed of the sheet 3 is completed normally. Further, based on the detection time of the rear end 3B of the sheet 3, the feed timing for the next sheet 3 is determined.

Further, in the present embodiment, the sheet end detection sensor 9 is used also for detecting whether the retaining plate 17 is in a raised state. That is, as described above, when the retaining plate 17 is not in a completely raised state, the operation of feed, stop, and hold of the sheet 3 is not achieved by the feed roller 5 and hence the sheet end detection sensor 9 does not detect the presence of the sheet 3. Accordingly, when the presence of the sheet 3 is detected by the sheet end detection sensor 9, a completely raised state of the retaining plate 17 is detected. In contrast, when the presence of the sheet 3 is not detected, a not-yet completely raised state of the retaining plate 17 is detected.

That is, in the present embodiment, a sheet presence or absence detection sensor for detecting the presence or absence of the sheet 3 and a retaining plate rise detection sensor for detecting the rise state of the retaining plate 17 are not provided dedicatedly. The detection of these states is achieved by the sheet end detection sensor 9 provided usually for detecting the conveyance state of the sheet 3 or the like.

On the conveyance path P1, a conveyance roller (an example of a "second conveyance section") 7; and registration rollers 8 consisting of a driving roller 8A and a driven roller 8B are provided. The driving roller 8A of the registration rollers 8 is connected to the main motor 47, for example, through a gear mechanism (not illustrated) so that a driving force from the main motor 47 is transmitted to the driving roller 8A.

The registration rollers 8 have the function of further conveying onto the belt unit 13 of the image forming section 12 the sheet 3 conveyed along the conveyance path P1. Further, in the upstream and the downstream of the registration rollers 8, a pre-registration sensor 10 and a post-registration sensor 11, respectively, are provided for detecting the presence or absence of the sheet 3 at corresponding positions. The pre-registration sensor 10 and the post-registration sensor 11 detect the presence or absence of the sheet 3 at corresponding positions. At that time, similarly to the sheet end detection sensor 9, the pre-registration sensor 10 and the post-registration sensor 11 detect passage of the front end 3A and the rear end 3B of the sheet 3. Specifically, each of the pre-registration sensor 10 and the post-registration sensor 11 generates a predetermined detection signal (goes ON) when passage of the front end 3A of the sheet 3 is detected, and then turns OFF the detection signal when passage of the rear end 3B of the sheet 3 is detected. The pre-registration sensor 10 and the post-registration sensor 11 are used, for example, for determining the timing necessary in various kinds of control of the image forming section 12 based on the detection of the front end 3A of the sheet 3.

The image forming section 12 includes a belt unit 13, exposure sections 18, process sections 20, a fixing assembly 31 and the like.

The belt unit 13 includes an annular belt 15 extended around a pair of belt support rollers 14 arranged on the front and the rear sides, respectively. When the belt support roller 14 on the rear side is driven and rotated, the belt 15 is circulated in the clockwise direction in the paper surface of FIG. 1 so that the sheet 3 supported on the upper face of the belt 15 is conveyed rearward. Further, four transfer rollers 16 are provided inside the belt 15.

Above the belt unit 13, four exposure sections 18 and four process sections 20 are provided. Each exposure section 18 includes an LED unit corresponding to one color selected from black, yellow, magenta, and cyan. Then, each exposure section 18 has an LED head 19 at the bottom end. In each exposure section 18, light emission is controlled based on the data of an image to be formed, so that light is projected from the LED head 19 onto the surface of the photosensitive drum 28.

Each process section 20 includes one of four process cartridges 20K, 20Y, 20M, and 20C corresponding to the above-mentioned four colors. Each of the process cartridges 20K to 20C includes: a cartridge frame 21; and a development cartridge 22 attached to the cartridge frame 21 in a detachable manner. Each development cartridge 22 includes: a toner accommodation chamber 23 accommodating toner of each color serving as developing powder; and a supply roller 24 and a developing roller 25 both arranged under the toner accommodation chamber 23.

The toner supplied from the toner accommodation chamber 23 is supplied to the developing roller 25 by rotation of the supply roller 24, and then is positively charged by friction between the supply roller 24 and the developing roller 25. Further, in association with rotation of the developing roller 25, the toner supplied onto the developing roller 25 enters the space between the layer thickness control blade 26 and the developing roller 25, and here is positively charged by friction to a satisfactory extent. As a result, the toner is supported on the developing roller 25 in the form of a thin layer of constant thickness.

Under the cartridge frame 21, provided are: a photosensitive drum 28 whose surface is covered by a photosensitive layer having positive electrification property; and a charging unit 29. At the time of image formation, the surface of the photosensitive drum 28 is positively charged uniformly by the charging unit 29. Then, the positively charged part is exposed by the exposure section 18, so that an electrostatic latent image is formed in the surface of the photosensitive drum 28.

Then, the toner supported on the developing roller 25 and positively charged is supplied to the electrostatic latent image on the surface of the photosensitive drum 28. As a result, the electrostatic latent image on the photosensitive drum 28 is visualized. After that, in the course that the sheet 3 passes through each nip position between each photosensitive drum 28 and each transfer roller 16, the toner image supported on the surface of each photosensitive drum 28 is sequentially transferred onto the sheet 3 by virtue of a transfer voltage of negative polarity applied to the transfer roller 16.

Then, the sheet 3 onto which the toner image has been transferred is conveyed to the fixing assembly 31 by the belt unit 13. The fixing assembly 31 performs press conveyance of the sheet 3 conveyed from the transfer roller 16, and thereby fixes the developer image having been transferred onto the sheet 3. The fixing assembly 31 includes: a heating roller 31A having a heat source; and a pressing roller 31B pressing the sheet 3 against the heating roller 31A. During the time that the sheet 3 passes through the fixing assembly 31, the image formation surface side of the sheet 3 is pressed against the heating roller 31A so that the transferred toner image is thermally fixed on the sheet 3. The sheet 3 having undergone thermal fixing in the fixing assembly 31 is conveyed upward and then discharged onto the upper face of the body casing 2 by the discharge roller 33.

2. Electrical Configuration

Next, the electrical configuration of the printer 1 (sheet feed device) is described below with reference to FIG. 2.

As illustrated in FIG. 2, the printer 1 has a CPU 40, a ROM 41, a RAM 42, and an NVRAM (non-volatile memory) 43 (an example of a "storage section"). These components are connected to the image forming section 12, the sheet end detection sensor 9, the pre-registration sensor 10, the post-registration sensor 11, the timer 44, the display section 45, and the operation section 46 (an example of a "reception section"), the main motor 47, the retaining plate drive section 48, and the sheet quantity detection section 49. Here, it should be noted that the sheet end detection sensor 9, the pre-registration sensor 10, the NVRAM 43, the timer 44, the display section 45, the operation section 46, the main motor 47, the retaining plate drive section 48, and the sheet quantity detection section 49 are included in the sheet feed device 50 and that the CPU 40 serves as the control section of the sheet feed device 50. Further, employable configurations for the control section are not limited to a CPU and may be, for example, an ASIC (application-specific IC).

The display section 45 includes a liquid crystal display, lamps, and the like, and displays various kinds of setting screens, the operation state of the apparatus, various kinds of warning, and the like. The operation section 46 includes a plurality of buttons, and receives various kinds of input operation from a user.

The ROM 41 stores various kinds of programs used for executing the operation of the printer 1, like precedence sheet feed processing to be described later. Based on the programs read from the ROM 41, the CPU 40 controls the individual sections with storing processing results into the RAM 42 or the NVRAM 43.

Further, the ROM 41 stores data of various kinds of predetermined time values used for comparison judgment with various kinds of time values measured by the timer 44.

According to the control by the CPU 40, the main motor 47 rotates via corresponding drive sections the rotating bodies such as the feed roller 5, the separation roller 6, the conveyance rollers 7, the registration rollers 8, the transfer roller 16, the supply rollers 24, the photosensitive drums 28, the heating roller 31A, and the belt unit 13.

The retaining plate drive section 48 includes: various kinds of gears converting a rotating force of the main motor 47 into rising motion of the retaining plate 17; and an electromagnetic solenoid (an electromagnetic clutch) switching the transmission of the rotating force. Here, a clutch or the like other than the electromagnetic clutch may be employed. Further, the sheet quantity detection section 49 detects the quantity of sheets on the retaining plate 17.

For example, according to a printing instruction inputted through the operation section 46 by a user, the CPU 40 controls the individual sections of the printer 1 so as to perform printing. For example, at the time that the operation section 46 receives a sheet feed instruction in association with the printing instruction, the CPU 40 causes the feed roller 5 to feed further the sheet 3 when the presence of the sheet 3 is detected by the sheet end detection sensor 9. In contrast, when the presence of a sheet 3 is not detected, the CPU 40 causes the retaining plate drive section 48 to raise the retaining plate 17 and then causes the feed roller 5 to start the feed of a sheet 3.

Further, after completion of the rise of the retaining plate 17, the CPU 40 controls the retaining plate drive section 48, the feed roller 5, the separation roller 6, and the separation pad 6A such that the front end 3A of the sheet 3 is detected by the sheet end detection sensor 9 and then, according to the detection of the front end 3A, the sheet 3 is stopped and held. As such, sheet feed prior to the sheet feed instruction is performed (precedence sheet feed control). This sheet feed prior to the sheet feed instruction reduces the time of sheet feed in the printing operation.

Further, when the sheet feed prior to the sheet feed instruction is performed, the CPU 40 causes the feed roller 5, the separation roller 6, and the separation pad 6A to stop and hold the sheet 3 in such a manner that the front end 3A of the sheet 3 is located between the sheet end detection sensor 9 and the conveyance rollers 7. This avoids an adverse effect (the occurrence of curl, or alternatively a situation that the sheet is conveyed directly from the pinching position) possibly caused in a case that a conveyance section to be provided usually for further conveyance, like the conveyance rollers 7, continues to pinch the sheet 3.

Here, in the present embodiment, "the time that a sheet feed instruction is received" indicates the time that a sheet feed instruction relevant to each sheet 3 is received from the printer driver during the time the printing operation is executed based on a printing instruction inputted through the operation section 46 by a user or the like.

3. Retaining Plate and Sheet Preparation Operation (Precedence Sheet Feed Control)

Figure 3:
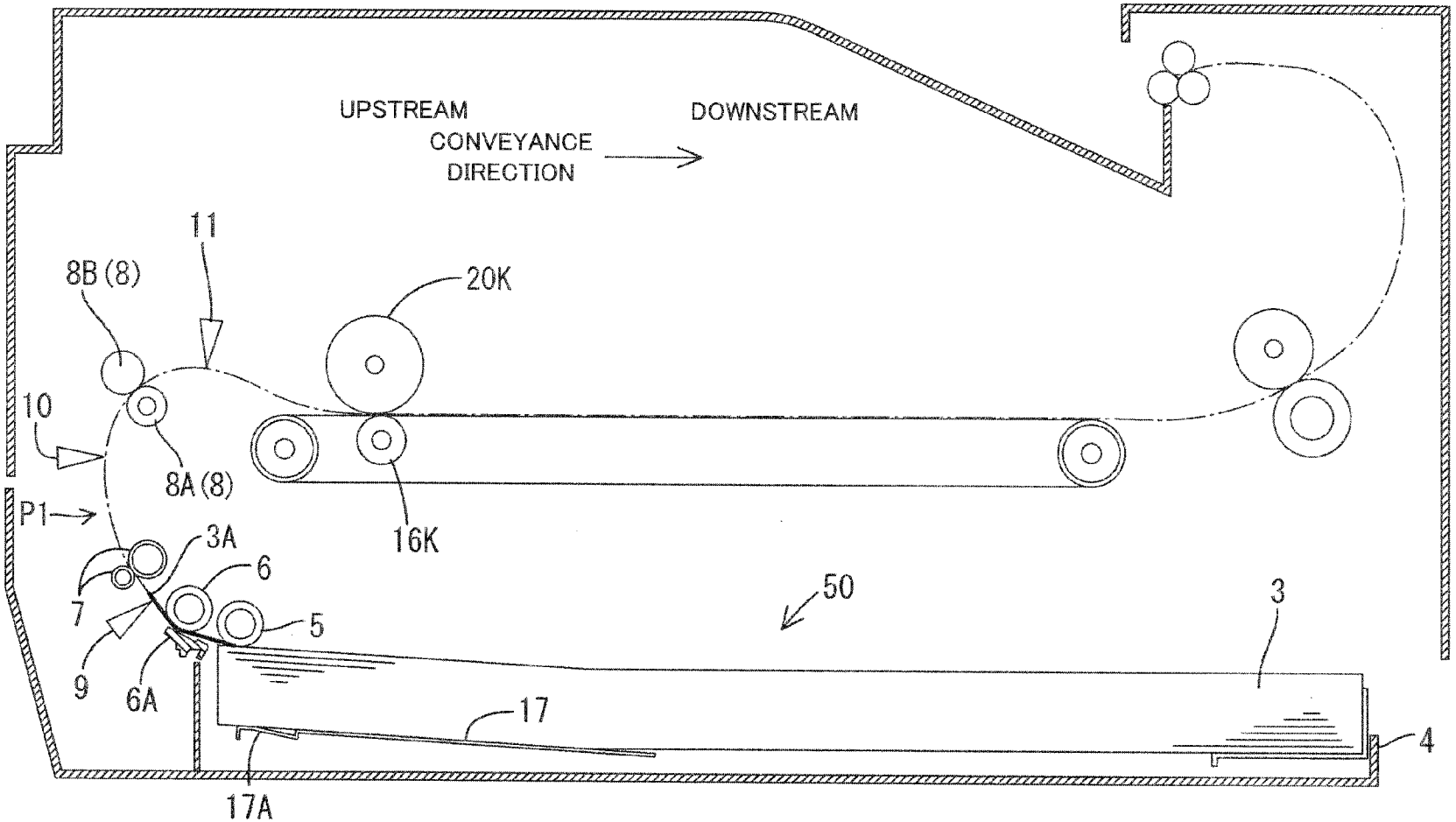
FIG. 3 is a diagram describing the state of a sheet according to precedence sheet feed control.
Figure 4:
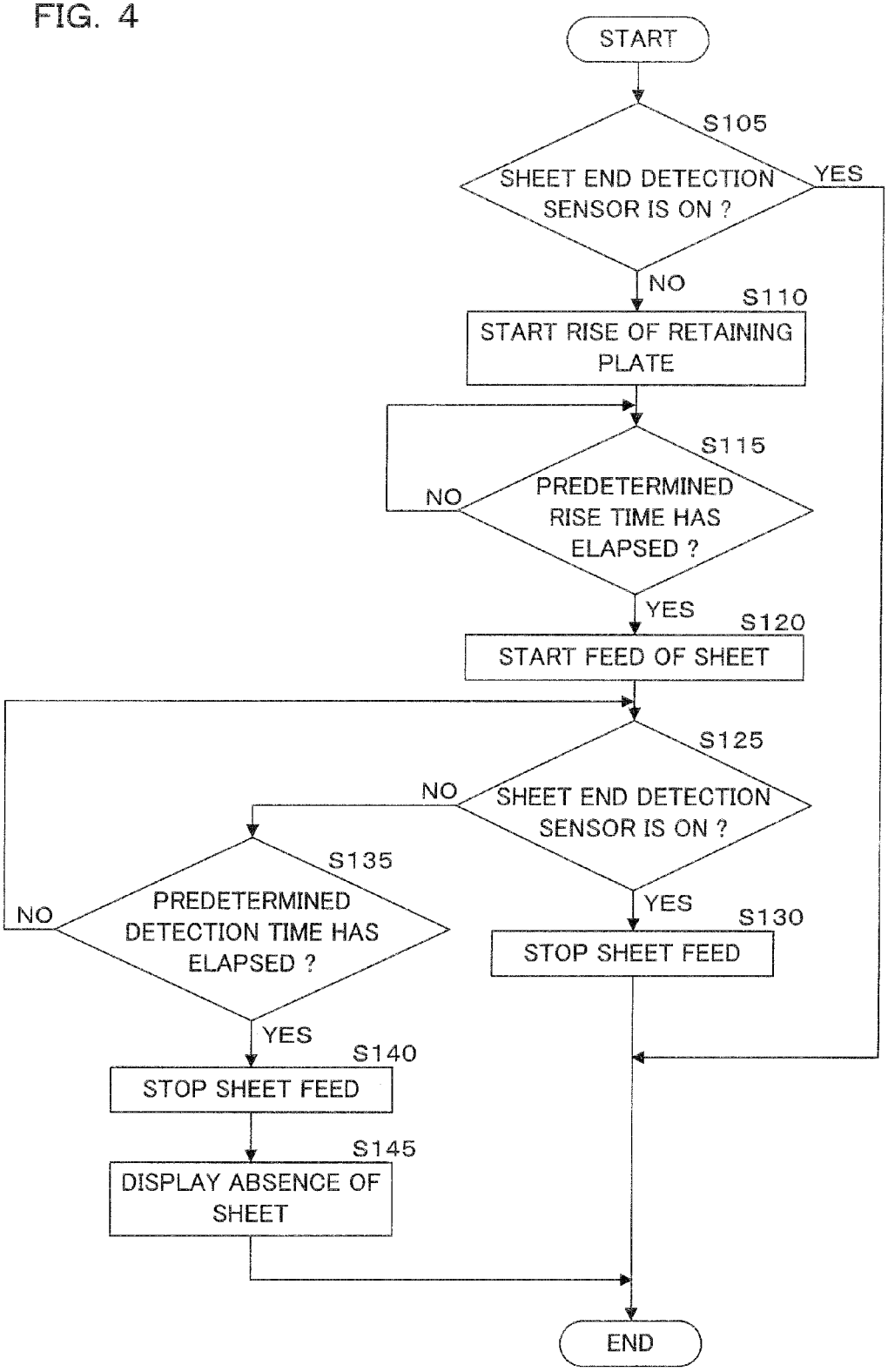
FIG. 4 is a flow chart illustrating a procedure of retaining plate and sheet preparation operation (precedence sheet feed control)

Next, retaining plate and sheet preparation operation according to the present embodiment is described below with reference to FIGS. 3 and 4. FIG. 3 is a diagram describing the state of a sheet 3 in precedence sheet feed control during retaining plate and sheet preparation operation. FIG. 4 is a flow chart illustrating a procedure of retaining plate and sheet preparation operation (precedence sheet feed control).

Here, in the retaining plate and sheet preparation operation, performed are: detection of a sheet; detection of rise of the retaining plate; and sheet feed prior to a sheet feed instruction. The retaining plate and sheet preparation operation (precedence sheet feed control) is preferably performed, for example, at the time of power ON (warm-up start) of the printer 1 and at the time of canceling of a sleep state. Further, the retaining plate and sheet preparation operation may be performed during the printing operation for the preceding sheet 3, after the completion of print of the preceding sheet 3, at the time of jam cancellation, or at the time of closing of the sheet feed tray 4. Here, at the time of warm up of the printer 1, the fixing assembly 31 is heated up by the heating roller 31A and other kinds of operation is performed. Further, in a sleep state of the printer 1, the printer 1 goes into a state of lower power consumption in comparison with the state of normal operation so that, for example, the heating for the fixing assembly 31 is stopped.

When the printer 1 is switched ON by a user or the like, the CPU 40 starts processing relevant to the retaining plate and sheet preparation operation based on a predetermined program. As illustrated in FIG. 4, the CPU 40 first judges whether the sheet 3 having undergone the previous precedence sheet feed has caused the sheet end detection sensor 9 to be ON, that is, whether the sheet end detection sensor 9 has detected the presence of the sheet 3 (step S105).

When it is judged that the sheet end detection sensor 9 is ON (step S105: YES), it is recognized that the front end 3A of the sheet 3 has reached the downstream in the sheet conveyance direction relative to the sheet end detection sensor 9, that is, sheet feed is already completed prior to a sheet feed instruction, thereby this processing being terminated. In other words, it is recognized that the retaining plate 17 is already raised and a sheet 3 is present, thereby this processing being terminated.

In contrast, when it is judged that the sheet end detection sensor 9 is not ON (step S105: NO), the CPU 40 controls the main motor 47 and the retaining plate drive section 48 so as to start the rise of the retaining plate 17, specifically, one end 17A of the retaining plate (step S110).

When a predetermined rise time has elapsed (step S115: YES), the CPU 40 drives the feed roller 5 and the separation roller 6 so as to start the feed of the sheet 3 (step S120). When the predetermined rise time has not yet elapsed (step S115: NO), the CPU 40 waits until the predetermined rise time elapses. Here, the distance of feed of the sheet is a predetermined distance necessary for the front end 3A of the sheet 3 to reach a predetermined position between the sheet end detection sensor 9 and the conveyance rollers 7. The predetermined distance is determined, for example, by the time elapsing from the time that the sheet end detection sensor 9 detects the front end 3A of the sheet 3. Then, the CPU 40 judges whether the sheet end detection sensor 9 is turned ON according to the feed of the sheet 3 (step S125).

When it is judged that the sheet end detection sensor 9 is ON (step S125: YES), sheet feed is stopped (step S130). Then, in a case that the present control is performed at the time of power ON of the printer 1, the present control is terminated. Here, in a case that the present control is performed during the printing operation for the preceding sheet 3, sheet feed is stopped and then printing operation described later is performed. Alternatively, step S130 is skipped and then printing operation is performed. Further, at step S125, when it is judged that the sheet end detection sensor 9 is ON, it is determined that the retaining plate 17 has been raised normally and a sheet is present.

In contrast, when it is judged that the sheet end detection sensor 9 is not ON (step S125: NO), the CPU 40 judges whether a predetermined detection time has elapsed (step S135). When it is judged that the predetermined detection time has elapsed in a state that the sheet end detection sensor 9 is not ON (step S135: YES), the CPU 40 stops the feed operation (step S140) and then displays "absence of sheet", for example, on the display section 45 (step S145). Here, the predetermined detection time used for detecting the "absence of sheet" is defined, for example, as twice the conveyance time elapsing between the time that the sheet 3 is fed from the sheet feed tray 4 by the feed roller 5 and the time that the sheet 3 is conveyed to the conveyance rollers 7. Further, the predetermined detection time is set appropriately depending on the length of a sheet having been fed prior to the feed instruction for the sheet 3.

As such, in a configuration that the retaining plate and sheet preparation operation (precedence sheet feed control) is performed with adopting as a trigger the completion of rise of the retaining plate 17 at the time of power ON of the printer 1, at the time of canceling of a sleep state, at the time of printing start, or the like, sheet feed is performed rapidly at the time of reception of a sheet feed instruction.

4. Printing Operation

Figure 5:
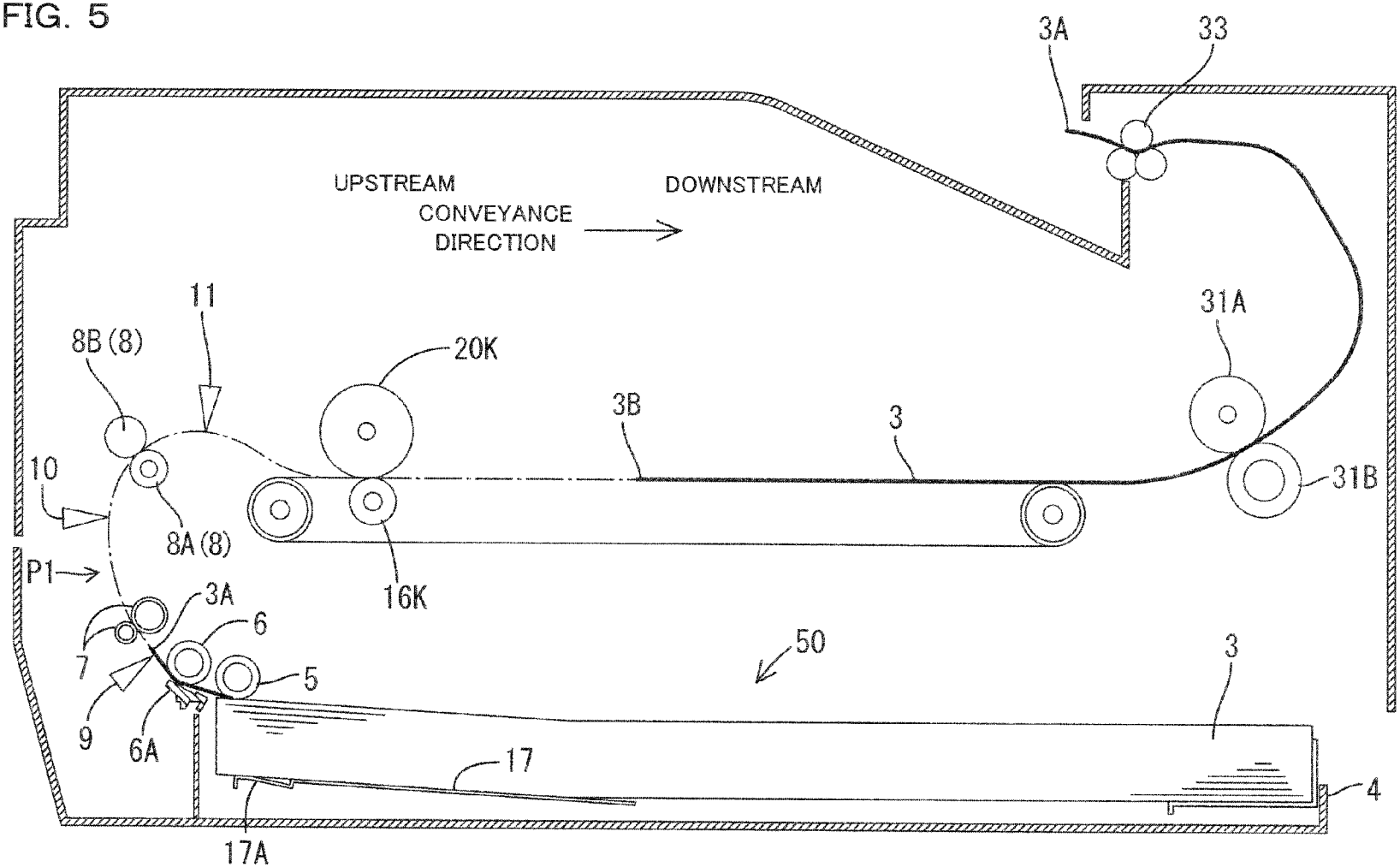
FIG. 5 is a diagram describing the state of sheets at the time of printing operation.
Figure 6:
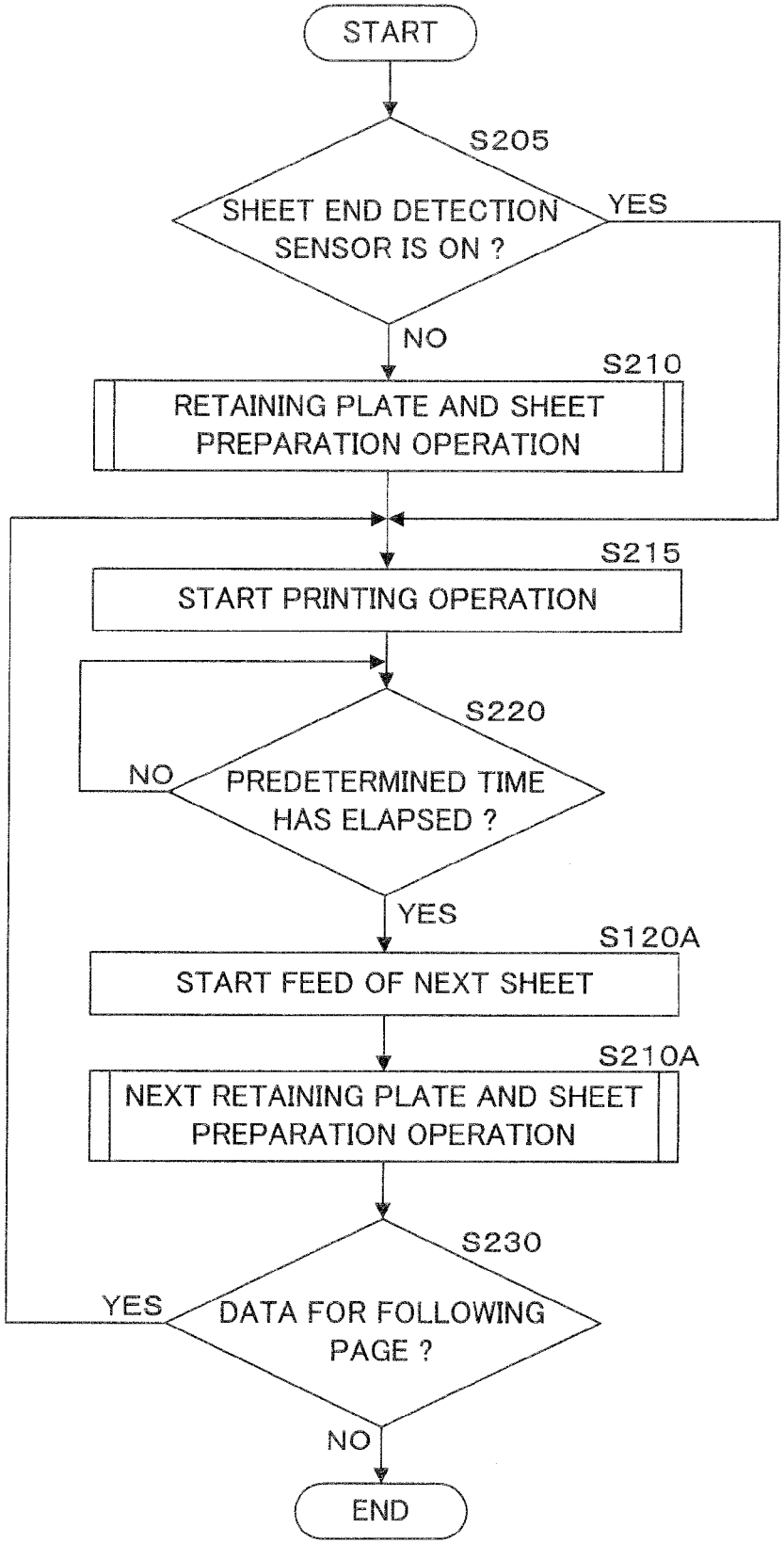
FIG. 6 is a flow chart illustrating a procedure of printing operation.

Next, printing operation according to the present embodiment, specifically, processing performed around the printing start, is described below with reference to FIGS. 5 and 6. FIG. 5 is a diagram describing the state of a sheet at the time of printing operation. FIG. 6 is a flow chart illustrating a procedure performed in printing operation.

When a printing instruction is received through the operation section 46, the CPU 40 starts processing relevant to the printing control according to a predetermined program. As illustrated in FIG. 6, the CPU 40 first judges whether the sheet 3 having undergone the previous precedence sheet feed has caused the sheet end detection sensor 9 to be ON, that is, whether the sheet end detection sensor 9 has detected the presence of the sheet 3 (step S205).

When it is judged that the sheet end detection sensor 9 is ON (step S205: YES), the CPU 40 recognizes that sheet feed is already completed prior to the sheet feed instruction, and hence starts printing operation (step S215). Here, the start of printing operation is performed such that the rollers such as the feed roller 5, the separation roller 6, and the conveyance rollers 7 are rotated so that the sheet 3 is further fed and conveyed in the direction toward the conveyance rollers 7 (toward the downstream in the sheet conveyance direction).

In contrast, when it is judged that the sheet end detection sensor 9 is not ON (step S205: NO), the retaining plate and sheet preparation operation (precedence sheet feed control) consisting of step S110 to step S145 (except for step S130) in FIG. 4 is performed (step S210). Then, the above-mentioned printing operation is started (step S215). Here, after step S145 of the retaining plate and sheet preparation operation, the procedure does not go to step S215 and the present processing is terminated.

Then, the CPU 40 judges whether a predetermined time relevant to the gap of the paper has elapsed (step S220). Here, the predetermined time relevant to the gap of the paper is a time length used for determining whether the interval between the first sheet 3 and the next sheet 3 has reached a predetermined distance. That is, for example, the predetermined time is a time length measured from the time that the rear end 3B of the first sheet is detected by the sheet end detection sensor 9. The predetermined time is measured by the timer 44.

When it is judged that the predetermined time has elapsed (step S220: YES), the feed of the next sheet 3 is started (step S120A). Then, the retaining plate and sheet preparation operation (precedence sheet feed control) consisting of step S105 to step S145 in FIG. 4 is performed on the next sheet 3 (step S210A). Here, after the step S145, the procedure does not go to step S230 and the present processing is terminated. Further, in a case that a plurality of pages are to be printed, step S130 is skipped for pages to be printed. That is, the processing at step S130 is performed only on the sheet 3 following the last printing page.

Then, the CPU 40 judges the presence or absence of printing data for the following page (step S230). When it is judged that there is printing data for the following page (step S230: YES), the procedure returns to step S215 and then printing of the following page is started. In contrast, when it is judged that there is not printing data for the following page (step S230: NO), as illustrated in FIG. 3, the present processing is terminated in a state that the sheet for the following page is maintained in a precedence sheet feed state.

5. Effects of Present Embodiment

As described above, according to the present embodiment, even in a case that the retaining plate 17 is lowered by any reason, sheet feed is performed satisfactorily. At that time, the presence or absence of the sheet 3 and the rise state of the retaining plate 17 are detected merely by the sheet end detection sensor 9 provided usually. Thus, in comparison with a configuration that the detection is performed by a sheet presence or absence detection sensor and a retaining plate rise detection sensor, the number of detection sections is reduced.

That is, without the necessity of detection sections to be provided newly, the minimal detection section provided usually detects the presence or absence of the sheet 3 and the rise state of the retaining plate 17. This provides cost reduction also, in comparison with a configuration that dedicated sensors are provided for detecting the presence or absence of the sheet 3 and the rise state of the retaining plate 17.

Further, the sheet feed prior to a sheet feed instruction reduces the time of sheet feed in printing operation.

OTHER EMBODIMENTS

The present invention is not limited to the embodiment described above with reference to the drawings. For example, the following embodiments are also included in the scope of technique of the present invention.

(1) In the embodiment given above, the sheet quantity detection section 49 is provided for detecting the quantity of sheets on the retaining plate 17. Then, in the precedence sheet feed control, the CPU 40 controls the main motor 47, the retaining plate drive section 48, the feed roller 5, and the separation roller 6 such that the position of stop of the front end 3A of the sheet 3 is set up depending on the quantity of sheets on the retaining plate 17 detected by the sheet quantity detection section 49. In contrast, the CPU 40 may judge whether the precedence sheet feed control is to be performed depending on the quantity of sheets on the retaining plate 17 detected by the sheet quantity detection section 49. For example, when the quantity of sheets on the retaining plate 17 is 50% or lower of the full load, the precedence sheet feed control may be performed. Then, in case of 50% or higher, the precedence sheet feed control may be not performed. Here, detection of the quantity of sheets may be performed by estimation.

In general, when a large quantity of sheets are present on the retaining plate 17, the retaining plate 17 has a small inclination angle, thereby causing a large curl in the front end 3A of the sheet 3. This is because a smaller inclination angle in the retaining plate 17 results in a larger value of the angle in which at the time of sheet feed, the horizontal plane direction of the sheet 3 on the retaining plate 17 is changed toward the sheet conveyance direction. When the sheet is left in a curled state for a long time, the curl in the front end 3A part of the sheet 3 is maintained and hence easily causes jam. Thus, in this configuration, for example, in case that a larger quantity of sheets are retained on the retaining plate 17, the distance from the sheet end detection sensor 9 to the front end 3A of the sheet 3 on the downstream side in the sheet conveyance direction is reduced more so that the curled part of the sheet 3 is reduced. This avoids the situation that the front end 3A of the sheet 3 is maintained in a curled state.

Here, the detection of the quantity of sheets by the sheet quantity detection section 49 may be performed, for example, by a prediction counter (a down counter) provided in the NVRAM 43 and predicting the quantity of remaining sheets. In this case, in the prediction counter, the count is reset (into the full load quantity) when sheets are charged by a user.

Figure 7:
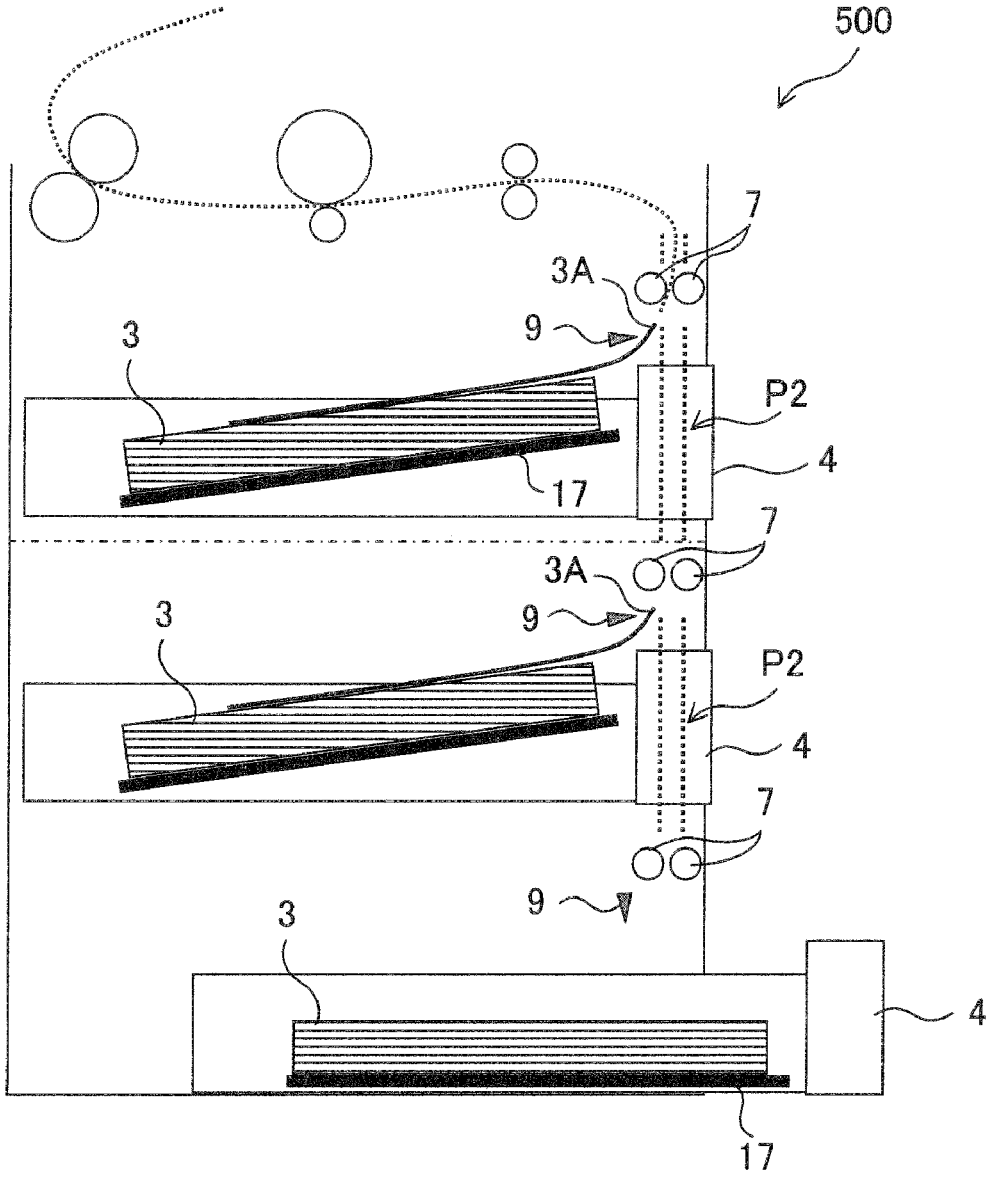
FIG. 7 is a diagram schematically illustrating a part of a printer provided with a common conveyance path shared with other sheet feed trays.

(2) The present invention is applicable also to a sheet feed device 500, as illustrated in FIG. 7, provided with: another sheet feed trays 4 provided under the sheet feed device 500 in the downstream in the sheet conveyance direction relative to the sheet end detection sensor 9; and a common conveyance path P2 shared with the another sheet feed trays 4. In this case, in the precedence sheet feed control, in order that the front end 3A of the sheet 3 should not collide with another sheet fed from the another sheet feed tray 4 into the common conveyance path P2, the CPU 40 adjusts the timing of stop of the operation of the feed roller 5, the separation roller 6, and the separation pad 6A from the ON timing of the sheet end detection sensor 9 and thereby adjusts the amount of feed of the front end 3A of the sheet 3 so that the sheet 3 to be fed is stopped prior to the sheet feed instruction.

In this case, the situation is avoided that the stopped sheet collides with the sheet fed from another sheet feed tray 4. Further, rapid sheet feed is achieved.

Further, in a sheet feed device 500 provided with at least one other sheet feed tray 4 arranged under the sheet feed device 500, the CPU 40 may perform precedence sheet feed control only onto the sheet feed tray(s) 4 other than the lowermost sheet feed tray 4. In this case, the situation is reliably avoided that the sheet stopped by precedence sheet feed control collides with the sheet fed from the lowermost sheet feed tray 4.

In the sheet feed device 500, the retaining plate 17, the feed roller 5, the separation roller 6, the separation pad 6A, the sheet end detection sensor 9, and the conveyance rollers 7 are provided for each sheet feed tray 4. Here, in FIG. 7, illustration of a part of components is omitted for simplicity, and like components are designated by like numerals.

Further, the CPU 40 may store into the NVRAM 43 or the like the precedence sheet feed information of the sheet feed device 50 concerning the precedence sheet feed control. Specifically, the NVRAM 43 may be provided with a 1-bit save information region for each sheet feed tray 4. Then, a precedence sheet feed state save flag may be stored as the precedence sheet feed information into the save information region. The sheet end detection sensors 9 are monitored continuously, and then, for each sheet feed tray 4, a precedence sheet feed state save flag "1" is stored at the time that the sheet end detection sensor 9 is turned ON in association with the passage of the front end 3A of the sheet 3 and hence that the precedence sheet feed is completed. Further, a precedence sheet feed state save flag "0" is stored at the time that the sheet end detection sensor 9 is turned OFF in association with the passage of the rear end 3B of the sheet 3. Then, based on the stored precedence sheet feed information, the CPU 40 controls the main motor 47, the retaining plate drive section 48, the feed roller 5, the separation roller 6, and the separation pad 6A. By virtue of this configuration, the control of sheet feed from each sheet feed tray 4 is performed in accordance with the state of each sheet feed tray 4.

Here, in the sheet feed device 50 provided with a single sheet feed tray 4, the precedence sheet feed information for the sheet feed tray 4 may be stored in a 1-bit save information region in the NVRAM 43. Then, based on this precedence sheet feed information, the main motor 47, the retaining plate drive section 48, the feed roller 5, the separation roller 6, and the separation pad 6A may be controlled.

(3) Whether the above-mentioned retaining plate and sheet preparation operation (precedence sheet feed control) is to be performed may be judged depending on the type of the sheet 3 stored in the sheet feed tray 4. That is, when the sheet 3 is a thick paper sheet, the part fed prior to the sheet feed instruction curls easily. Thus, for example, when a thick paper sheet is selected as the sheet 3, the retaining plate and sheet preparation operation may be not performed.

Further, whether the retaining plate and sheet preparation operation (precedence sheet feed control) is to be performed may be judged depending on the size of the sheet 3 stored in the sheet feed tray 4. That is, when the sheet 3 is a small size sheet, the part fed prior to the sheet feed instruction curls easily. Thus, for example, when a sheet of size B5 is selected as the sheet 3, the retaining plate and sheet preparation operation may be not performed.

Further, when double-side printing is to be performed, the retaining plate and sheet preparation operation (precedence sheet feed control) may be not performed.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A sheet feed device comprising:

a retaining section retaining a sheet;

a drive section raising the retaining section;

a first conveyance section conveying the sheet on the raised retaining section in a conveyance direction;

a sheet detection section being provided on a downstream side in the conveyance direction relative to the first conveyance section, and detecting one end of the sheet conveyed by the first conveyance section;

a control section, at the time that a reception section receives a sheet feed instruction, when the one end of the sheet is detected by the sheet detection section, causing the first conveyance section to further convey the sheet in the conveyance direction, and when the one end of the sheet is not detected by the sheet detection section, causing the drive section to raise the retaining section and then causing the first conveyance section to start conveyance of the sheet.

2. The sheet feed device according to claim 1, wherein the first conveyance section can cause the sheet to stop at a predetermined position on a conveyance path, and the control section, at a predetermined timing before reception of a sheet feed instruction, as sheet preparation operation prior to the sheet feed instruction, causes the drive section to raise the retaining section, and then causes the first conveyance section to convey the sheet to a position where the one end of the sheet is detected by the sheet detection section, and causes the first conveying section to stop the sheet at the predetermined position on the conveyance path after detection of the one end of the sheet by the sheet detection section.

3. The sheet feed device according to claim 2, further comprising:

a second conveyance section being provided on a downstream side in the conveyance direction relative to the sheet detection section, wherein:

the control section causes the first conveyance section, as the sheet preparation operation, to convey and then stop the sheet at the predetermined position such that the one end of the sheet is located between the sheet detection section and the second conveyance section, and the control section, after the reception section receives the sheet feed instruction, causing the second conveyance section to further convey the sheet in the conveyance direction.

4. The sheet feed device according to claim 3, further comprising:

a retaining unit comprising the retaining section and being movable between a first position capable of feed of the sheet and a second position incapable of feed of the sheet, wherein:

during the time that the retaining unit is being moved to the second position, the drive section lowers the retaining section in a raised state, the first conveyance section includes a separation roller abutting against the sheet from above and a separation member opposite to the separation roller with the sheet in between so as to separate the sheet from another sheet retained below the sheet, and during the time that the retaining unit is being moved to the second position, the separation member goes lower in accordance with lowering of the retaining section.

5. The sheet feed device according to claim 4, further comprising:

a plurality of the retaining units;

a common conveyance path shared by the plurality of retaining units, wherein the control section, as sheet preparation operation prior to the sheet feed instruction, causes the first conveyance section to stop the sheet to be fed prior to the sheet feed instruction, such that a front end of the sheet to be conveyed from one retaining unit to the common conveyance path should not collide with the other sheet conveyed from the other retaining unit to the common conveyance path.

6. The sheet feed device according to claim 5, wherein the plurality of retaining units are stacked, for the retaining unit other than the lowermost retaining unit, the control section, as sheet preparation operation prior to the sheet feed instruction, causes the first conveyance section to stop a sheet to be fed prior to the sheet feed instruction, such that a front end of the sheet conveyed from the retaining unit other than the lowermost retaining unit to the common conveyance path should not collide with the other sheet conveyed from the lowermost retaining unit to the common conveyance path.

7. The sheet feed device according to claim 2, further comprising a sheet quantity detection section detecting a quantity of one or more sheets retained by the retaining section, wherein the control section sets a position of a front end of a sheet of the one or more sheets to be stopped according to a quantity of the one or more sheets retained by the retaining section detected by the sheet quantity detection section.

8. The sheet feed device according to claim 2, further comprising a sheet quantity detection section detecting a quantity of one or more sheets retained by the retaining section, wherein when a quantity of the one or more sheets retained by the retaining section detected by the sheet quantity detection section exceeds a predetermined quantity, the control section does not perform sheet preparation operation prior to the sheet feed instruction.

9. The sheet feed device according to claim 2, further comprising a storage section storing precedence sheet feed information based on sheet preparation operation prior to the sheet feed instruction, wherein the control section controls the drive section and the first conveyance section based on the precedence sheet feed information stored in the storage section.

10. The sheet feed device according to claim 1, wherein in a case that the sheet detection section does not detect the sheet even when a predetermined time has elapsed since the sheet detection section has started detection of a sheet, the control section notifies the outside of predetermined information.

11. An image forming apparatus comprising:

a sheet feed device according to claim 1; and an image forming section forming an image on a sheet fed from the sheet feed device.

12. A method for feeding a sheet when a sheet feed instruction is received at a sheet feed device comprising:

a retaining section retaining a sheet, a drive section raising the retaining section, a conveyance section conveying the sheet on the raised retaining section in a conveyance direction and being capable of causing the sheet to stop at a predetermined position on a conveyance path, and a sheet detection section being provided on a downstream side in the conveyance direction relative to the conveyance section, and detecting one end of the sheet conveyed by the conveyance section, the method comprising:

a sheet preparation step performed at a predetermined timing before a reception of the sheet feed instruction, the sheet preparation step comprising:

a raising step of the drive section raising the retaining section;

a first conveying step of the conveyance section conveying the sheet after the raising step at least to a position where the one end of the sheet is detected by the sheet detection section; and a stopping step of the conveyance section stopping the sheet after the first conveying step according to detection of the one end of the sheet by the sheet detection section;

a second conveying step of, at the time that the sheet feed instruction is received, the conveyance section further conveying the sheet when the one end of the sheet is detected by the sheet detection section; and a step of, at the time that the sheet feed instruction is received, causing the drive section to raise the retaining section and then causing the conveyance section to start conveyance of a sheet when the one end of the sheet is not detected by the sheet detection section.

* * * * *